US011455856B2

(12) United States Patent
Kato et al.

(10) Patent No.: US 11,455,856 B2
(45) Date of Patent: Sep. 27, 2022

(54) PAPER SHEET HANDLING DEVICE

(71) Applicant: Hitachi-Omron Terminal Solutions, Corp., Tokyo (JP)

(72) Inventors: Atsushi Kato, Tokyo (JP); Yasutoshi Hayashi, Tokyo (JP); Ryota Kawaguchi, Tokyo (JP)

(73) Assignee: HITACHI CHANNEL SOLUTIONS, CORP., Tokyo (JP)

( * ) Notice: Subject to any disclaimer, the term of this patent is extended or adjusted under 35 U.S.C. 154(b) by 848 days.

(21) Appl. No.: 16/313,339

(22) PCT Filed: Jun. 5, 2017

(86) PCT No.: PCT/JP2017/020847
§ 371 (c)(1),
(2) Date: Dec. 26, 2018

(87) PCT Pub. No.: WO2018/051585
PCT Pub. Date: Mar. 22, 2018

(65) Prior Publication Data

US 2019/0156609 A1 May 23, 2019

(30) Foreign Application Priority Data

Sep. 16, 2016 (JP) ..... JP2016-182095

(51) Int. Cl.

| | |
|---|---|
| ***G07D 7/15*** | (2016.01) |
| ***G07D 7/121*** | (2016.01) |
| ***G07D 7/164*** | (2016.01) |
| ***G07D 7/183*** | (2016.01) |
| ***G07D 7/189*** | (2016.01) |

(52) U.S. Cl.
CPC ..... *G07D 7/15* (2017.05); *G07D 7/121* (2013.01); *G07D 7/164* (2013.01); *G07D 7/183* (2017.05); *G07D 7/189* (2017.05)

(58) Field of Classification Search
CPC ..... G07D 7/15; G07D 7/121; G07D 7/164; G07D 7/183; G07D 7/189
USPC ..... 209/11
See application file for complete search history.

(56) References Cited

U.S. PATENT DOCUMENTS

| | | | | |
|---|---|---|---|---|
| 2003/0234362 | A1* | 12/2003 | Thierauf | G07D 7/189 250/341.6 |
| 2010/0117295 | A1 | 5/2010 | Miyamoto | |
| 2019/0156609 | A1* | 5/2019 | Kato | G07D 7/15 |

FOREIGN PATENT DOCUMENTS

| | | | | |
|---|---|---|---|---|
| CN | 107111907 B | * | 3/2020 | G07D 7/164 |
| EP | 0097570 A2 | * | 6/1983 | G01B 7/08 |
| EP | 0097570 A2 | * | 4/1984 | G07D 7/026 |
| JP | 2013-054446 A | | 3/2013 | |

(Continued)

OTHER PUBLICATIONS

English-language translation of International Search Report, PCT/JP2017/020847 (dated Aug. 15, 2017).

*Primary Examiner* — Terrell H Matthews
(74) *Attorney, Agent, or Firm* — Foley & Lardner LLP

(57) ABSTRACT

The present invention is provided with: a heat source unit; a heat detection unit that detects the intensity of light of a prescribed wavelength obtained from paper sheets in which heat provided from the heat source unit is stored; and a control unit that detects, on the basis of the intensity of the light of the prescribed wavelength obtained from the paper sheets, a repaired paper sheet which has been repaired with a repair member.

6 Claims, 7 Drawing Sheets

(56) References Cited

FOREIGN PATENT DOCUMENTS

| | | | | | |
|---|---|---|---|---|---|
| JP | 5210013 | B2 * | 6/2013 | ..... | G07D 7/12 |
| WO | WO 2009/013787 | A1 | 1/2009 | | |
| WO | WO-2009013787 | A1 * | 1/2009 | ..... | B65H 7/02 |
| WO | WO-2018051585 | A1 * | 3/2018 | ..... | G07D 7/121 |

* cited by examiner

PAPER SHEET HANDLING DEVICE

TECHNICAL FIELD

The present invention relates to a paper sheen handling device, and more particularly to handling of a repair paper sheet.

BACKGROUND ART

Automatic teller machines (ATM) and automatic cash sorting machines (sorters) have a bill validator for discriminating denominations of a bill, authenticity of the bill, or damage of the bill such as dirt, folding, and tear. The ATM and the sorter have a function of collecting tape repair bills as one of the functions of discriminating the damage of the bill. The collecting function is a function of accepting deposits of the bill whose tear has been repaired with an adhesive tape or the like and not returning the repair bill to another user as handling of an unrecyclable damaged bill. Such a bill is stored in a collection safe box in the ATM and stored in an exclusive collection pocket in the sorter. A technique for detecting the bill repaired with the adhesive tape is disclosed in, for example, PTL 1. PTL 1 discloses a technique in which a bill thickness detection sensor holds a medium to be transported between two metal rollers, measures the amount of displacement of one metal roller displaced according to the medium thickness amount at that time, and detects whether or not there an adhesive tape attached to the bill, based on the thickness and its area.

CITATION LIST

Patent Literature

PTL 1: Japanese Patent Application Laid-Open No. 2013-54446

SUMMARY OF INVENTION

Technical Problem

In the above PTL 1, the amount of displacement of the metal roller is measured, and the tape attached to the bill is detected based on the thickness and the area. However, in the above PTL 1, since whether or not there is the tape is detected based on the amount of displacement of the metal roller, there is a case where there is a difference in the amount of displacement, for example, between a folded bill (hereinafter referred to merely as "folded bill") such Z-folding in the center and the repair bill (hereinafter referred to merely as "repair bill") with a repairing member such as the adhesive tape described above when the bill passes through the thickness detection sensor, thereby being incapable of correctly distinguishing those bills from each other. The reason is that, in order to distinguish between those bills, there is a need to ensure a performance of performing an accurate measurement by the thickness detection sensor in units of microns. However, from the viewpoint of a mechanical structure, a detection width in the scanning direction cannot be narrowed. For that reason, there has been a demand for a technology capable of accurately detecting the repair bill and the folded bill. In addition, technique capable of accurately distinguishing the repair bill from the folded bill has been demanded.

The present invention has been made in view of the above circumstances, and therefore it is an object of the present invention to provide a paper sheet handling device capable of detecting a repair bill with high precision. Another object of the present invention is to provide a paper sheet handing device capable of distinguishing a repair bill and a folded bill from each other with high precision.

Solution to Problem

According to a preferred example of the present invention, a paper sheet handling device according to the present invention includes a heat source unit, a heat detection unit that detects an intensity of a prescribed wavelength light obtained from a paper sheet which stores a heat supplied from the heat source unit, and a control unit that detects a repair paper sheet repaired with a repairing member based on the intensity of the prescribed wavelength light obtained from the paper sheet.

Advantageous Effects of Invention

According to the present invention, the repair bill can be detected with high precision. In addition, the repair bill and the folded bill can be distinguished from each other with high precision.

DESCRIPTION OF EMBODIMENTS

Figure 1:
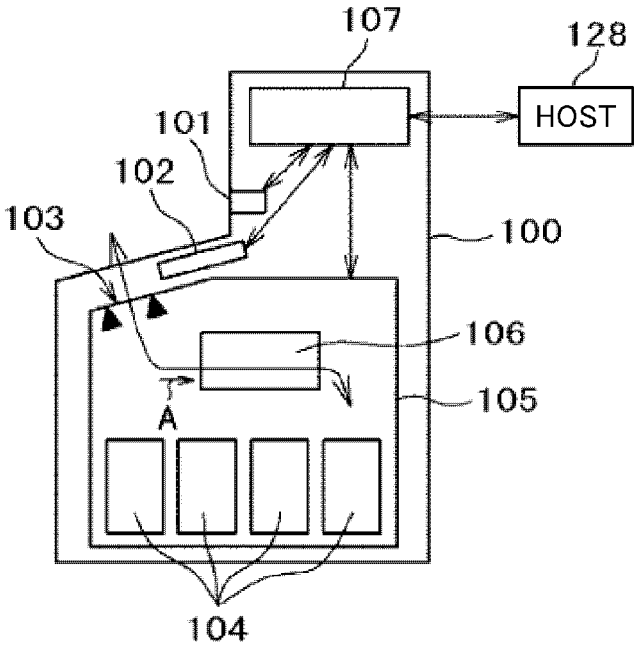
FIG. 1 is a diagram showing a schematic configuration of an ATM according to an embodiment.

Hereinafter, a paper sheet handling device according to an embodiment of the present invention will be described in detail with reference to the accompanying drawings. In the following description, the paper sheet handling device is applied to an ATM or a sorter. Alternatively, the paper sheet handling device can be applied to devices handling various tradable paper sheets, such as checks and gift certificates FIG. 1 is a diagram showing a schematic configuration of an ATM 100 to which the paper sheet handling device is applied. As shown in FIG. 1, the ATM 100 includes a card reader and printer 101, a display panel 102, a bill deposit and withdrawal port 103, a safe cassette 104, a bill deposit and withdrawal mechanism 105, a bill validator 106, and a control unit 107.

The card reader and printer 101 permits insertion of an IC card for transaction with the ATM 100 by a user and outputs a detailed statement printing transaction results carried out between the user and the ATM 100. The display panel 102 is configured by, for example, a touch panel, accepts various operation involved in the transaction from the user, or displays various information involved in the transaction carried out between the user and the ATM 100.

The bill deposit and withdrawal port 103 receives bills to be deposited for transaction from the user or dispenses the bill traded to the user. The safe cassette 104 is a storage box that stores recyclable bills for each denomination. The bill deposit and withdrawal mechanism 105 performs a process involved in the bill such as a bill deposit and withdrawal transaction. The bill validator 106 identifies the denomination of the bills to be deposited or withdrawn, and determines the authenticity of the bill.

The control unit 107 controls the operation of each unit configuring the ATM 100. For example, the control unit 107 determines whether the bill is a repair bill or a folded bill based on the information obtained from the bill validator 106. The ATM 100 is connected to a host computer 108 through a communication unit and a network, which are not shown.

For example, the ATM 100 performs the deposit and withdrawal of the bills according to information input or instructed by the user through the display panel 102. In the ATM 100, in the case of depositing, the bill validator 106 determines the denomination, authenticity, and damage of the bills inserted into the bill deposit and withdrawal port 103 by the user, and transports the bills to an appropriate safe cassette 104 or bill deposit and withdrawal port 103. In the case of withdrawal, the ATM 100 transports the bills from the safe cassette 104 and the bill validator 106 scrutinizes the bills and transports the scrutinized bills to the bill deposit and withdrawal port 103.

In the following description, the case where the paper sheet handling device is applied to the ATM is described. Alternatively, the paper sheet handling device can be applied to, for example, an automatic cash sorter (sorter).

Figure 2:
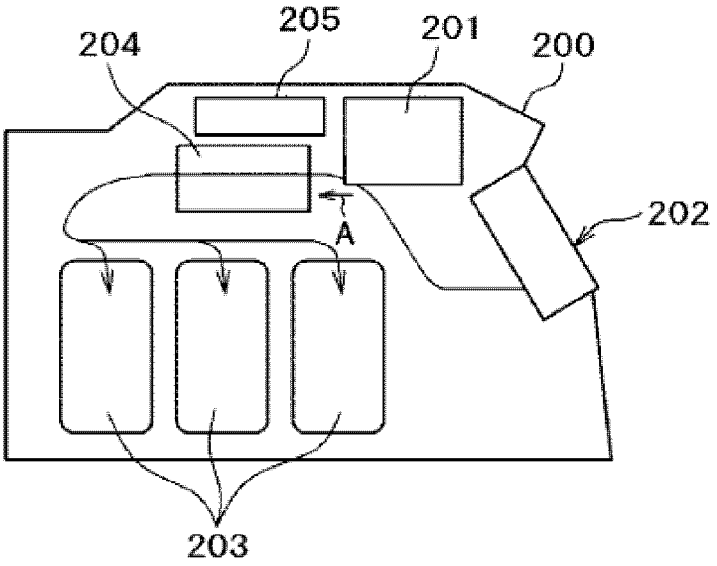
FIG. 2 is a diagram showing a schematic configuration of a sorter according to the embodiment.

FIG. 2 is a diagram showing a schematic configuration of a sorter 200 to which the paper sheet handling device is applied. As shown in FIG. 2, the sorter 200 includes a display panel 201, a bill insertion slot 202, a sorting pocket 203, a bill validator 204, and a control unit 205 as hardware.

The display panel 201 receives various operations involved in sorting of the bills from an attendant or displays various information involved in sorting of the bills performed between the attendant and the sorter 200. The insertion port 202 accepts the insertion of the bills to be sorted from the attendant. The sorting pocket 203 is a storage box for storing the sorted bills for each denomination.

The bill validator 204 determines the denomination of the bills to be sorted, the authenticity of the bills, and so on. The control unit 205 controls the operation of each unit that configures the sorter 200. For example, the control unit 205 determines whether the bill is the repair bill or the folded bill, based on the information obtained from the unit 204. The sorter 200, as with the ATM 100, may be connected to a host computer through a communication unit or a network, which are not shown.

Figure 3:
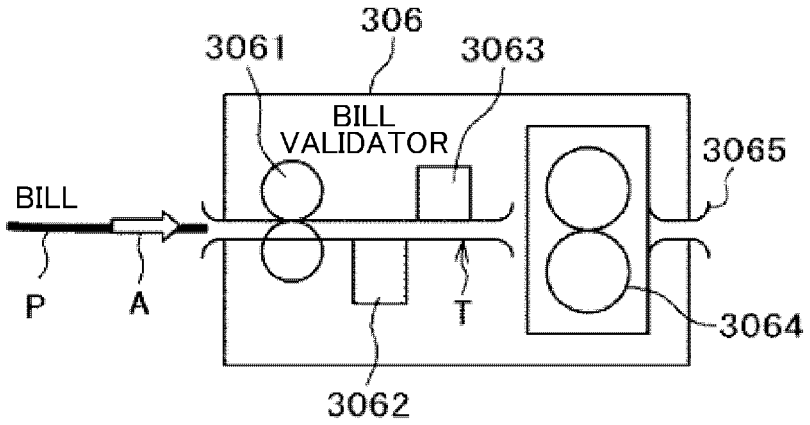
FIG. 3 is a diagram showing a schematic configuration of a conventional bill validator.

In the case of the sorter, the bill validator 204 determines the denomination, authenticity, and damage of the bills set in the bill deposit and withdrawal port 202 according to the information input or instructed by the attendant by operating the display panel 201, and transports the determined bills to the sorting pocket 203 according to the information set by the attendant. FIGS. 1 and 2 show a state in which the bills are transported to a transport direction A. Next, a description will be given of the bill validator provided in the ATM 100 and the sorter 200. First, a conventional configuration will be described. FIG. 3 shows a schematic configuration of a conventional bill validator. As shown in FIG. 3, a conventional bill validator 306 includes transport rollers 3061, an optical sensor 3062, a magnetic sensor 3063, a thickness detection sensor 3064, and a transport guide 3065.

The transport rollers 3061 are configured to transport the bills P transported in the transport direction A into the bill validator 306. In this example, although a pair of transport rollers 3061 is provided across a transport path T, the number of transport rollers 3061 can be arbitrarily determined according to a length of the transport path T. The optical sensor 3062 is configured to acquire an image of the bills P transported in the transport direction A.

The magnetic sensor 3063 is configured to acquire the magnetic characteristics of the bill P. The thickness detection sensor 3064 is configured to detect the thickness of the bill P. The thickness detection sensor 3064 includes a pair of rollers, and detects the thickness of the bill P by detecting the amount of vertical movement of the bill P.

The transport guide 3065 is configured to transport the bill P to a downstream transport path. In this way, the conventional bill validator 306 includes the transport rollers 3061 and the transport guide 3065 for transporting the bills, and the sensors to be used for various determinations, which are disposed along the transport path T.

Next, the bill validator 106 according to the present embodiment will be described.

Figure 4:
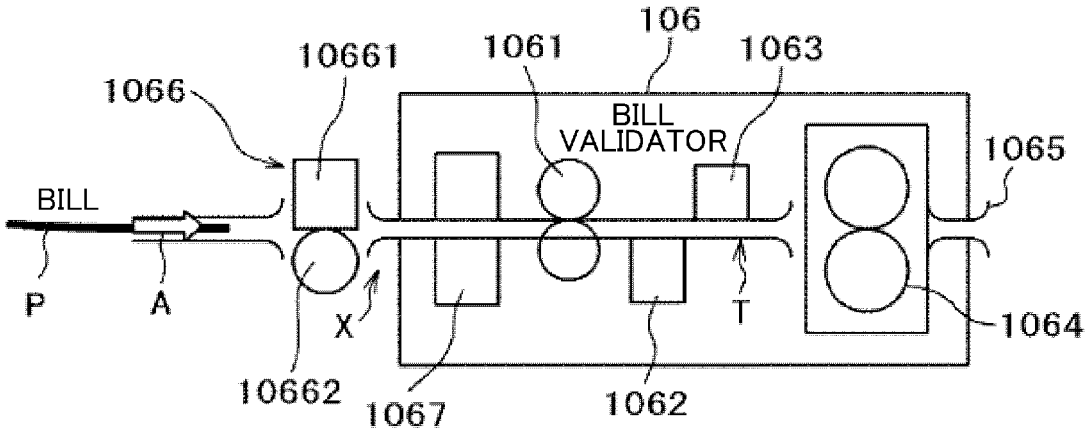
FIG. 4 is a diagram showing a schematic configuration of a bill validator according to the embodiment.

FIG. 4 is a diagram showing a schematic configuration of the bill validator according to the present embodiment. As shown in FIG. 4, the bill validator 106 includes transport rollers 1061, an optical sensor 1062, a magnetic sensor 1063, a thickness detection sensor 1064, a transport guide 1065, a heat generation mechanism unit 1066, and a thermosensor unit 1067. The transport rollers 1061, the optical sensor 1062, the magnetic sensor 1063, the thickness detection sensor 1064, and the transport guide 1065 are the same as the transport rollers 3061, the optical sensor 3062, the magnetic sensor 3063, the thickness detection sensor 3064, and the transport guide 3065 shown in FIG. 3, and hence a description of those components will be omitted.

The heat generation mechanism unit 1066 is configured to include a heat source unit 10661 and a transport roller 10662. The heat source unit 10661 is configured to include, for example, an object to be heated, a high-frequency power source, and a coil. The heat source unit 10661 generates a strong magnetic field by passing a current obtained from a high frequency power supply through the coil and generates heat by an electric heat resistance generated at that time. The transport roller 10662 is disposed at a position that faces the heat source unit 10661 across the transport path T, and is rotated by a driving source (not shown) to transport the bills P in the transport direction A.

In this example, the heat generation mechanism unit 1066 is provided on the upstream side of the thermosensor unit 1067 outside the bill validator 106. The reason why the heat generation mechanism unit 1066 is provided outside the bill validator 106 is that when the heat generation mechanism unit 1066 is provided inside the bill validator 106, a temperature of the bill validator 106 rises due to heat and the detection accuracy of each sensor is lowered. However, if a mechanism for releasing the heat, such as an opening, is provided in a body of the bill validator 106, the heat generation mechanism unit 1066 may be provided inside the bill validator unit 106.

Figure 5:
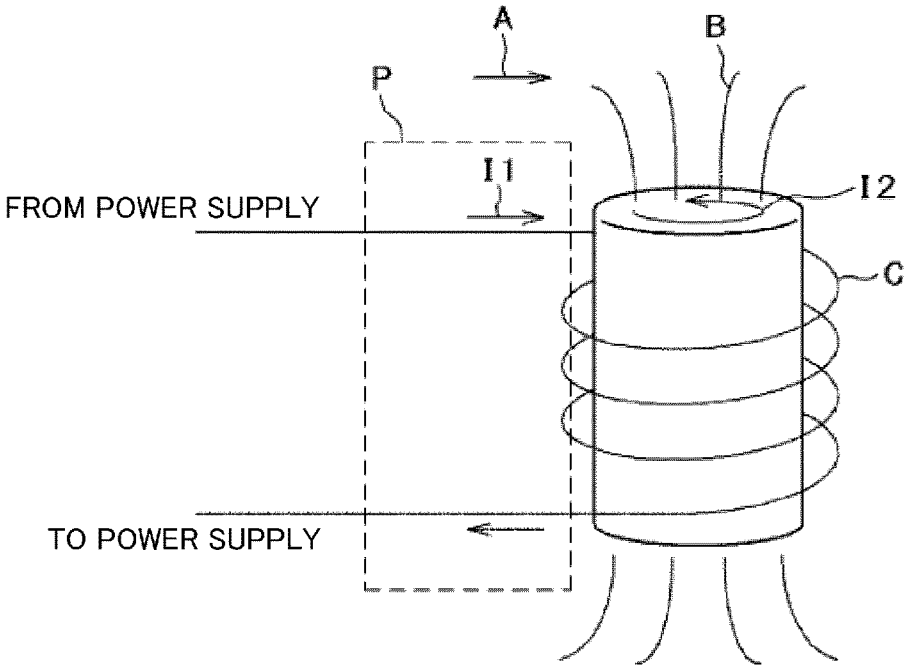
FIG. 5 is a top view showing a schematic configuration of a heat generation mechanism.

FIG. 5 is a top view showing a schematic configuration of the heat source unit 10661. As shown in FIG. 5, in the heat source unit 10661, when a coil current I1 is supplied from a power supply (not shown) to a coil C, a magnetic flux B is generated to generate an eddy current I2 in the vicinity of a surface of the object to be heated (for example, a metal having a high thermal conductivity), and the object to be heated is heated by the Joule heat. In the present embodiment, since the coil C is winded around the object to be heated, the heat can be uniformly and efficiently transferred to the bill P in a short time. Then, returning to FIG. 4, the thermosensor unit 1067 will be described.

The thermosensor unit 1067 is an infrared sensor including one or multiple elements for detecting an intensity of the infrared wavelength. The thermosensor unit 1067 detects a change in electrical properties attributable to an increase in the temperature of the elements due to the infrared ray.

Figure 6:
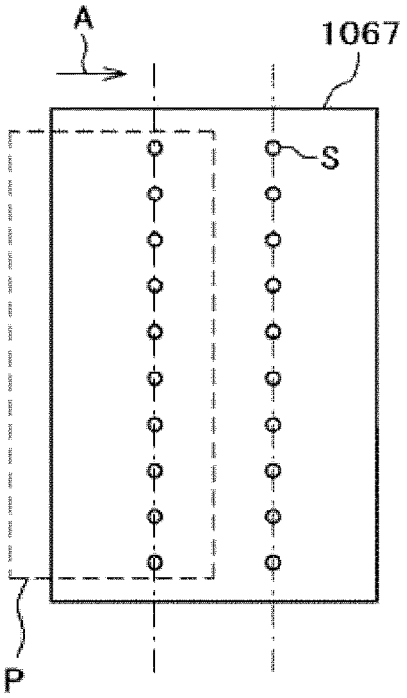
FIG. 6 is a top view showing a schematic configuration of a thermosensor unit.

FIG. 6 is a top view showing a schematic configuration of the thermosensor unit 1067. As shown in FIG. 6, in the thermosensor unit 1067, the multiple elements S are arrayed in a plane direction perpendicular to the transport direction. A of the bill P (in this example, a longitudinal direction of the bill), and each of the elements detects infrared rays obtained from the bill P. In FIG. 6, two rows of element groups are provided in the transport direction A, and one element group is provided with ten elements S arrayed in the vertical plane direction. In FIG. 5, the bill P is transported to a first row of element groups, and the infrared rays obtained from the bill P are detected by each element S configuring the element group.

In this example, the thermosensor unit 1067 is provided at the upper and lower positions facing each other across the transport path T, but in the case where a physical space is restricted such that there is no space at the upper and lower positions, the thermosensor unit 1067 may be provided at any one position. As in this example, the amount of heat can be measured with high accuracy at the upper and lower positions, but the location may be appropriately selected according to the discrimination performance specification and the cost.

In addition, in this example, the thermosensor unit 1067 may be provided inside the bill validator 106. Alternatively, the thermosensor unit 1067 may be provided outside the bill validator 106 at a position X on the downstream side of the heat source unit 10661. With the provision of the thermosensor unit 1067 outside the bill validator 106, the bill validator 106 can be reduced in size, and the present configuration can be realized by using the conventional validator 106 as it is. The heat source unit 10661 may be provided upstream of the thermosensor unit 1067 and the thermosensor unit 1067 may be provided upstream of the bill validator 106. A spacing at which those units are placed may be determined according to setting environments such as a transport speed and the sensitivity of the elements S. In this way, according to the present embodiment, in addition to the optical sensor, the magnetic sensor, and the thickness detection sensor which have been conventionally used, the thermosensor unit 1067 for detecting the intensity of the infrared rays obtained from the bills by the heat generation mechanism unit 1066 is provided.

In the bill validator 106 having the conventional configuration shown in FIG. 3, the thickness of the bill is detected only by the thickness detection sensor 3064. For that reason, there is a case where whether the transported bill is a repair bill or a folded bill cannot be correctly distinguished. However, as described above, focusing on the heat storage amount and the heat storage rate makes it possible to accurately distinguish between the repair bill and the folded bill.

Figure 7:
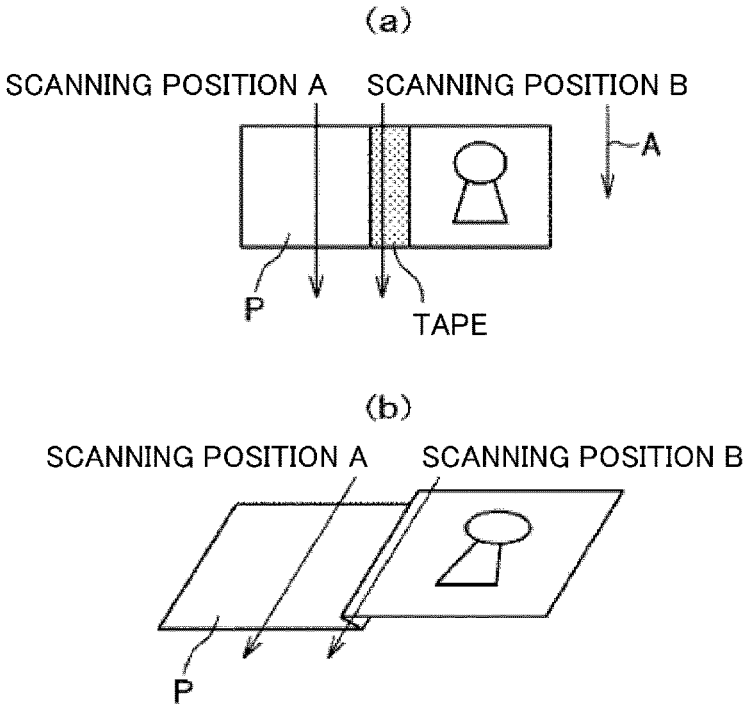
FIG. 7 are diagrams showing examples of a repair bill and a folded bill.
Figure 8:
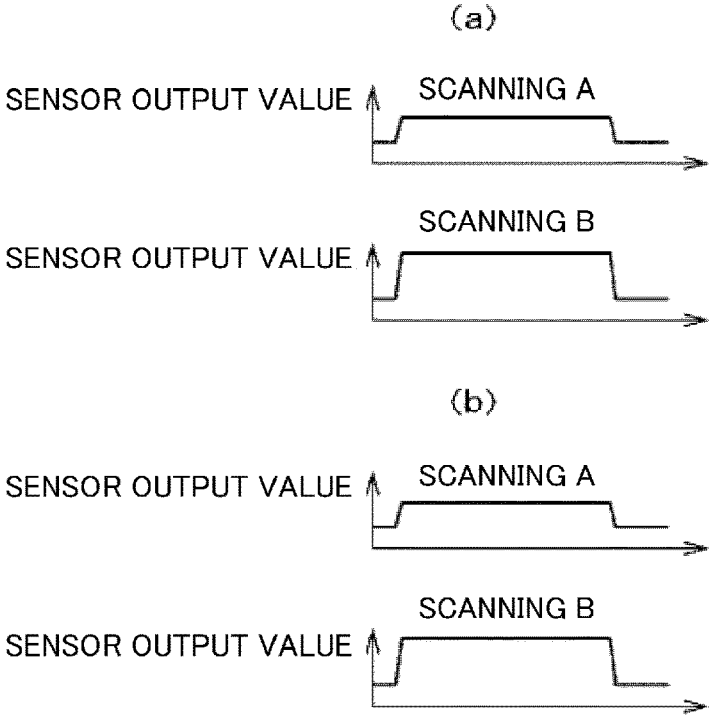
FIG. 8 are diagrams showing transition of an output value when a thickness detection sensor detects a repair bill and a folded bill.

FIG. 7 are diagrams showing an example of a repair bill and a folded bill, and FIG. 8 are diagrams showing a transition of an output value when the thickness detection sensor detects the repair bill and the folded bill. FIG. 7(*a*) shows an example in which a center portion is repaired by a repairing member over an entire short direction. When the repaired bill is transported in the transporting direction A, each element of the thermosensor portion 1067 (in this example, elements at a scanning position A and a scanning position B) scans the bill at those positions. The scanning position A is a position without the repairing member and the scanning position B is a position where a repairing member is attached. As shown in FIG. 8(*a*), when an output value of the element placed at the scanning position A and an output value of the element placed at the scanning position B are compared with each other, it is found that the latter is larger in the output value than the former. The reason is because the amount of displacement of the roller of the thickness detection sensor is increased by the thickness of the repair member.

FIG. 7(*b*) shows as example in which the center portion is folded over the entire short direction. When the folded bill is transported in the transport direction A, as in the case of FIG. 7(*a*), each element of the thermosensor unit 1067 scans the bill. The scanning position A is a position where there is no folding and the scanning position B is a position where there is a folding. As shown in FIG. 8(*b*), when an output value of the element placed at the scanning position A and as output value of the element placed at the scanning position B are compared with each other, as in FIG. 8(*a*), it is understood that the output value of the latter is larger than that of the former. The reason is because the amount of displacement of the roller of the thickness detection sensor is increased by the thickness of the bill caused by the folding as in the case of the thickness of the tape. Since the output value shown in FIG. 8(*b*) transitions substantially in the same way as the transition of the output value shown in FIG. 8(*a*) as described above, the thickness detection sensor cannot distinguish between the repair bill and the folded bill.

Therefore, in the present embodiment, paying attention to the heat storage effect generated between the repair bill and the folded bill, a difference between the repair bill and the folded bill is distinguished in other words, since the repairing member portion attached to the repair bill and the folded bill having no repairing member are different in material from each other, the heat storage amount and the heat storage rate are different between those bills. For that reason, as described below, the determination by the thermosensor unit is performed in addition to the determination by the thickness detection sensor.

As shown in FIG. 4, when the bill is transmitted to the bill validator 106, the heat source unit 10661 located upstream of the bill validator 106 radiates heat to heat the bill. Thereafter, the thermosensor unit 1067 provided between the heat source unit 10661 and the bill validator 106 detects the infrared rays obtained from the transported bill. As described above, when the bill passes through the thermosensor unit 1067, since the heat storage effect of the repair bill is different from that of the folded bill, the temperature is different between the repairing member portion and the bill portion. In general, it is determined by the Stefan-Boltzmann formula that the intensity of the infrared ray radiated by the temperature of a material is proportional to the fourth power of an absolute temperature rise.

$$I=\varepsilon\sigma T^4 \quad \text{[Ex. 1]}$$

I: radiated energy [W/cm$^2$]
σ: Stefan-Boltzmann constant $5.7\times10^{-12}$ [W/cm$^2$K$^4$]
ε: emissivity [$0\leq\varepsilon\leq1$]
T: object temperature [K]

Figure 9:
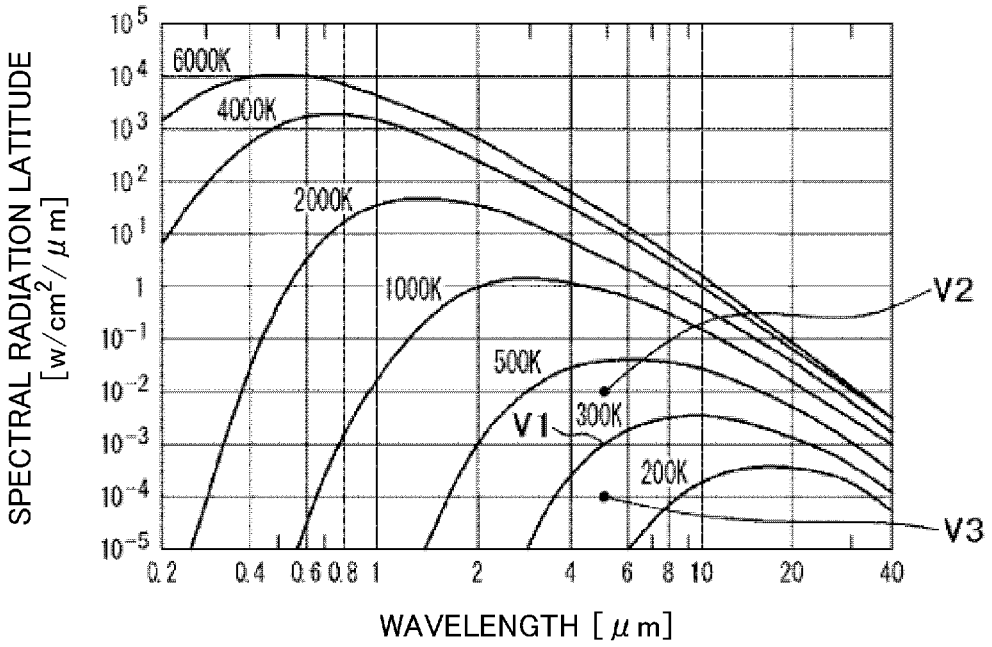
FIG. 9 is a diagram showing a relationship between an infrared wavelength and a radiant energy for each surface temperature of an object.

FIG. 9 is a graph showing a relationship between an infrared wavelength and a radiant energy for each surface temperature of the object according to the above formula. As shown in FIG. 9, it can be seen that the radiant energy is larger as the temperature is higher at the same wavelength. That is, it can be seen that the radiant energy is different between the repairing member and the bill portion having different heat storage effects even with the infrared rays of the same wavelength. For example, if the infrared wavelength is 5 μm and the radiation energy value obtained from the bill portion is V1, in the case of the repairing member having the high heat storage effect, the emissivity ε becomes high and the radiant energy with a value V2 larger than the above V1 is obtained. In the same way of thinking, in the case of the repairing member having the low thermal storage effect, the emissivity r decreases and the radiant energy with a value V3 smaller than the above V1 is obtained. That is, since the radiation energy obtained is different depending on a difference in emissivity between the bill and a material other than the bill, when the radiant energy exceeds a fixed range from a value of radiant energy obtained from the bill, there is a high possibility that the bill is repaired by some kind of repairing member, and it is conceivable that the transported bill is the repair bill.

As described above, in the present embodiment, the difference in the radiant energy is detected by an infrared wavelength detection element of the thermosensor unit 1067 with the use of the fact that the intensity of the infrared ray radiated from the material is different.

Figure 10:
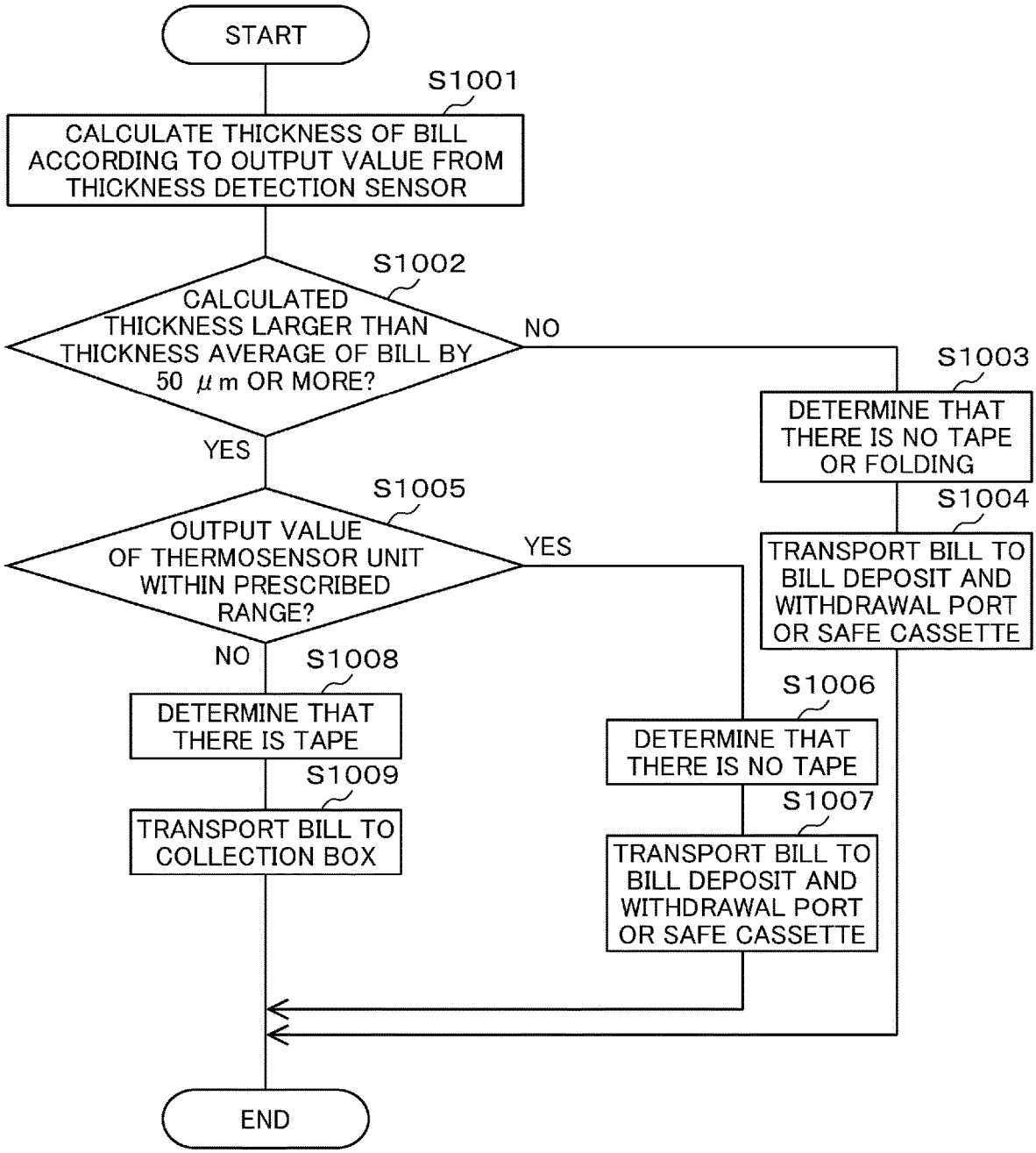
FIG. 10 is a flowchart showing a processing procedure of a bill discrimination process.

FIG. 10 is a flowchart showing a processing procedure of a process (bill discrimination process) performed by the bill validator 106. In FIG. 10, it is assumed that the transported bill has passed through the heat generation mechanism unit 1066, the thermosensor unit. 1067, and the thickness detection sensor 1064.

As shown in FIG. 10, in the bill discrimination process, the control unit 107 calculates the thickness of the bill according to the amount of displacement of the roller which is the output value of the thickness detection sensor 1064 (Step S1001). The control unit 107 determines whether or not the calculated thickness of the bill greater than a prescribed thickness of the bill by a prescribed value (for example, 50 μm) or more (Step S1002).

The prescribed thickness of the bill is, for example, an average value of the thicknesses of the various denominations handled by the ATM 100, and is information stored in advance in a memory in the control unit 107. As will be described below, when the control unit 107 determines that the calculated thickness of the bill is larger than the average value by the prescribed value or more, the bill is regarded as any one of the repair bill and the folded bill.

If the control unit 107 determines that the calculated thickness of the bill is not larger than the prescribed thickness of the bill by the prescribed value or more (NO in Step S1002), the control unit 107 determines that the transported bill is neither the repair bill nor the folded bill (Step S1003), and causes the bill to be transported to the bill deposit and withdrawal port 103 or the safe cassette 104 (Step S1004).

On the other hand, when the control unit 107 determines that the calculated thickness of the bill is larger than the prescribed thickness of the bill by at the prescribed value or more (YES in Step S1002), the control unit 107 further determines whether or not the output value of each element configuring the thermosensor unit 1067 falls within a prescribed range (Step S1005). The prescribed range is a range for distinguishing whether the transported bill is the repair bill or the folded bill, and is a range of the radiant energy obtained when the non-folded bill is irradiated with the infrared ray. In an example shown in FIG. 9, the prescribed range is a first range which is a range having a fixed width (a width Δ from between V1 and V2 and to between V1 and V3) from the radiant energy value V1 in the case where the infrared wavelength is 5 μm, and stored in a memory of the control unit 107 in advance.

The first range may be set as follows: For example, when the bill is a folded bill, since the volume of the folded portion of the paper is increased, the heat storage efficiency becomes high as compared with the other portions without folding. As a result, the output value of the element at the position of the folded portion becomes higher than the output value of the other elements. For that reason, the output value of the element at the folded portion is read in advance by repeating a test beforehand, and the average value of the read output values may be set as a boundary value in the prescribed range.

When the control unit 107 determines that the output values of the elements configuring the thermosensor unit 1067 are all within the first range (YES in Step S1005), the control unit 107 determines that the transported bill is not a repair bill (that is, a folded bill) (Step S1006). As in Step S1004, the control unit 107 causes the bill to be transported to the bill deposit and withdrawal port 103 or the safe cassette 104 (Step S1007).

On the other hand, when the control unit 107 determines that any of the output values of the elements configuring the thermosensor unit 1067 is not within the first range (NO in Step S1005), the control unit 107 determines that the transported bill is the repair bill (Step S1009), and causes the bill to be transported to the collection box (Step S1009). Any one of the safe cassettes 104 may be assigned to the collection box in advance. In the case of the sorter 200, any one of the sorting pockets 203 may be assigned to the sorter 200 as a collection pocket in advance. The output value which is not within the first range is within the second range which is outside the first range, and between an upper limit value and a lower limit value of the radiant energy, for example, when the infrared wavelength in FIG. 9 is 5 μm, and is stored in a memory within the control unit 107 in advance.

As described above, in the present embodiment, focusing on the fact that the heat storage efficiency of the bill is different depending on the presence or absence of the repairing member, it is distinguished whether the bill is the repair bill or the folded bill. In other words, normally, the repairing member is made of a material different from that of the bill and therefore the heat storage effect also differs. Accordingly, with the execution of the above process, the heat storage amount and the heat storage rate of the repairing member are compared with the heat storage amount and the heat storage rate of the bill. When a difference from the heat storage amount or heat storage rate assumed as the bill is a given value or more, it is determined that the bill is the repair bill repaired by the repairing member. When the difference from the heat storage amount or heat storage rate assumed as the bill is not the given value or more, it is determined that the bill is not the repair bill but the folded bill. Therefore, the repair bill and the folded bill can be distinguished from each other and detected with high precision, and the bill can be transported to an appropriate place in the device according to the damaged condition of the bill, thereby being capable of increasing a recovery rate of the damaged bills. In addition, the thickness detection sensor performed up to now and the processing focusing on the heat storage effect are executed in combination, thereby being capable of surely distinguishing between the repair bill and the folded bill. In addition, in this example, the processing focusing on the heat storage effect is executed after the thickness determination by the thickness detection sensor. For that reason, there is no need to execute the processing focusing on the heat storage effect on the bill whose thickness is a normal thickness, a processing load can be reduced, and the bill can be rapidly discriminated.

In the paper sheet discrimination process shown in FIG. 10, in Step S1005, it is determined whether or not all the output values of the respective elements of the thermosensor section 1067 fall within the first range, thereby determining whether the bill is the repair bill or the folded bill. However, for example, when the amount of bills to be handled is large, the number of times of heat generation of the heat source unit 10661 also increases to raise the temperature inside the device, and the output values of all the elements may exceed the set first range and fall within the second range, depending on the usage environment of the ATM 100. In addition, when the ATM 100 is installed outside a shop, the output values are likely to be affected by the external environment attributable to a change in the temperature, and the output values of all the elements may exceed the set first range and enter the second range.

In order to prepare for such a case, in the following description, since the output values of the thermosensor unit 1067 are compared with the first range for each element, even when the environment change as described above occurs, the repair bill and the folded bill are distinguished from each other with high precision.

Figure 11:
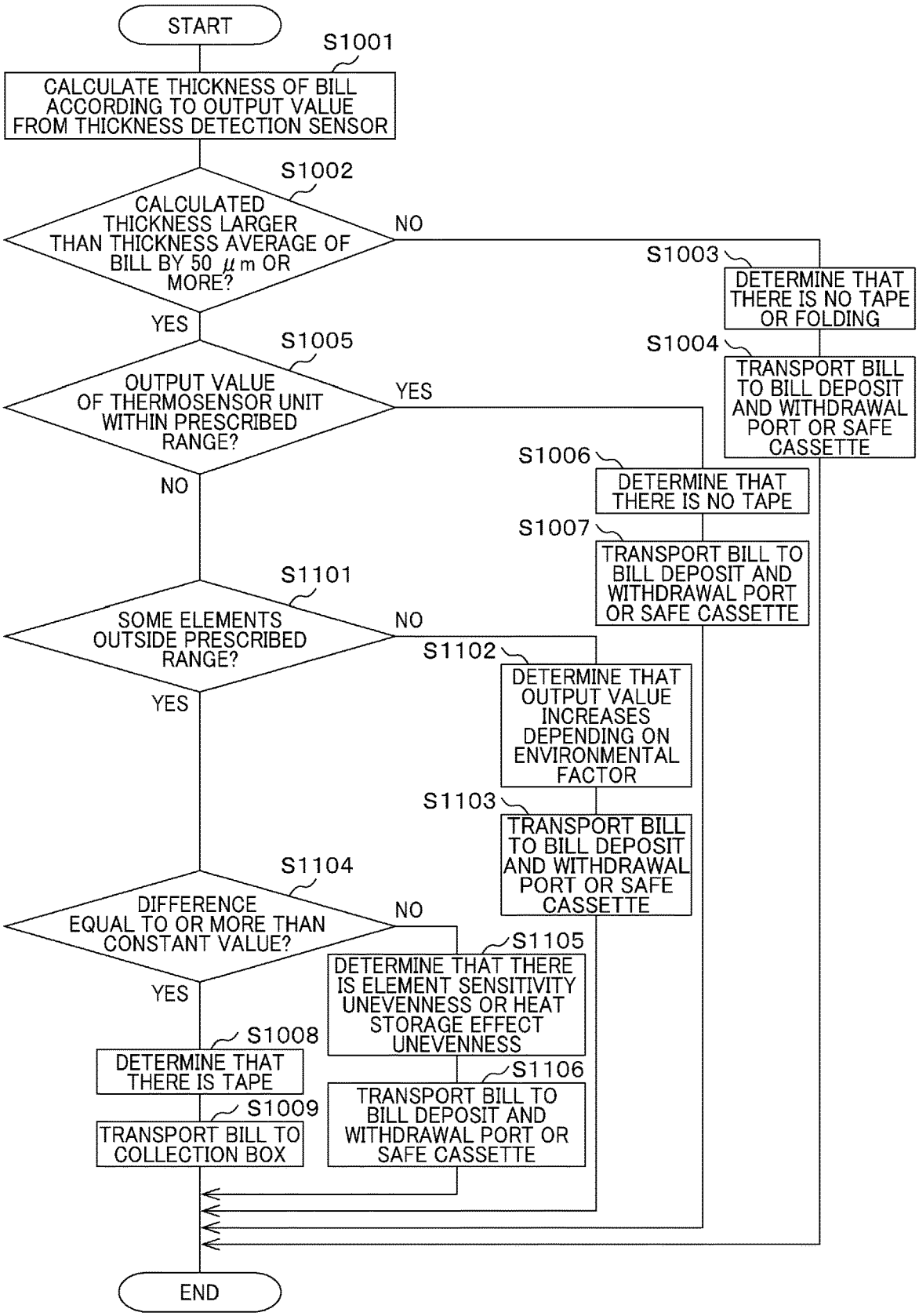
FIG. 11 is a flowchart showing a processing procedure of a bill discrimination process according to another embodiment.

FIG. 11 is a flowchart showing a modification of a processing procedure of a bill discrimination process shown in FIG. 10. Hereinafter, the same processing as in the steps shown in FIG. 10 will be denoted by the same step numbers, and a description of the same processing will be omitted.

As shown in FIG. 11, when the processing of Step S1005 is completed, the control unit 107 determines whether or not the output values of some of the elements exceed the first range and fall within the second range (Step S1101). If the control unit 107 determines that the output values of some of the elements do not exceed the first range, that is, that the output values of all the elements exceed the first range and fall within the second range (NO in Step S1101), the control unit 107 determines that the out values have increased due to an environmental factor such as a usage environment or an external environment. (Step S1102), and as in Step S1004, the control unit 107 causes the bill to be transported to the bill deposit and withdrawal port 103 or the safe cassette 104 (Step S1103). In this example, it is determined whether or not the output values of all the elements exceed the first range. However, if the output values of a given number or more of the elements exceed the first range, it may be determined that the output values have increased due to the environmental factor.

On the other hand, if the control unit 107 determines that the output values of some of the elements exceed the first range and fall within the second range (YES in Step S1101), the control unit 107 further determines whether or not a difference between the output value and a boundary value of the first range is equal to or more than a fixed value (Step S1104). If the control unit 107 determines that the difference between the output value and the boundary value of the first range is not equal to or more than the fixed value (NO in Step S1104), the control unit 107 determines that the difference is indicative of the sensitivity unevenness of the elements or the unevenness of the heat storage effect (Step S1105), and causes the bill to be transported to the bill deposit and withdrawal port 103 or the safe cassette 104 as in Step S1004 (Step S1106).

On the other hand, when the control unit 107 determines that the difference between the output value and the boundary value of the first range is equal to or larger than the fixed value (YES in Step S1104), the control unit 107 causes the bill to transported to the collection box as in Steps S1008 and S1009 shown in FIG. 10.

As described above, in the processing shown in FIG. 11, since it is determined whether or not the output value falls within the second range beyond the first range for each element of the thermosensor unit 1067, the repair bill and the folded bill can be distinguished from each other and detected with high precision by eliminating the influence of the use environment and the external environment or the influence of the sensitivity of each element and the influence of the unevenness of the heat storage effect.

When executing the process shown in FIG. 11, since the control unit 107 compares the output values of the respective elements of the thermosensor unit 1067 with each other, for example, in Step S1104, the control unit 107 may identify the elements whose output values exceed the prescribed range by the fixed value or more, to thereby determine at which position and range of the bill the repairing member is attached. For example, as shown in FIG. 6, when two rows of element groups are provided in the bill transport direction A, the positions of the elements configuring each element group are stored in advance in a memory of the control unit 107 and the positions and the output values are associated with each other, thereby being capable of grasping the position and range of the repairing member.

Actually, the processing performed by the control unit 107 can be executed by a CPU (Central Processing Unit) reading out a program stored in the memory of the control unit 107. The program is installed in the memory in advance and provided. However, the program may be provided as a file of installable format or executable format to the control unit 107.

In the present embodiment, the case where the repairing member for the repair bill is an adhesive tape has been described. However, the present invention is not limited to the above example, and various members can be used as the repairing members, such as when the bill is repaired with glue-adhered paper. In the present embodiment, the case where the folded bill is a z-folded bill has been described. However, the present invention is not limited to the above case and can be applied to bills of various folded shapes other than the z shape.

REFERENCE SIGNS LIST

100, ATM
101, card reader and printer
102, display panel
103, bill deposit and withdrawal port
104, safe cassette
105, bill deposit and withdrawal mechanism
106, bill validator

107, control unit
1061, transport roller
1062, optical sensor
1063, magnetic sensor
1064, thickness detection sensor
1065, transport guide
1066, heat generation mechanism unit
10661, heat source unit
10662, transport roller
1067, thermosensor unit
200, sorter
201, display panel
202, bill slot
203, sort pocket
204, bill validator
205, control unit
P, bill
C, coil
S, element.

The invention claimed is:

1. A paper sheet handling device, comprising:

a heat source unit;

a heat detection unit that detects an intensity of a prescribed wavelength light obtained from a paper sheet which stores heat supplied from the heat source unit; and a control unit that determines whether the paper sheet is a repair paper sheet repaired with a repairing member or a folded paper sheet, based on the intensity of the prescribed wavelength light obtained from the paper sheet.

2. The paper sheet handling device according to claim 1, wherein the control unit determines that the paper sheet is the folded paper sheet when the intensity of the prescribed wavelength light falls within a first range, and determines that the paper sheet is the repair paper sheet when the intensity of the prescribed wavelength light falls within a second range outside the first range.

3. The paper sheet handling device according to claim 1, further comprising a thickness detection unit that detects a thickness of the paper sheet, wherein the control unit performs determination based on the intensity of the prescribed wavelength light when it is determined whether the paper sheet is the repair paper sheet or the folded paper sheet, based on the detection result by the thickness detection unit.

4. The paper sheet handling device according to claim 2, wherein the heat detection unit includes a plurality of elements that detect the intensity of the prescribed wavelength light, and the control unit determines that the intensity of the prescribed wavelength light depends on an environmental factor when the intensity of the prescribed wavelength light within the second range is obtained from the plurality of elements.

5. The paper sheet handling device according to claim 2, wherein the control unit determines that the intensity of the prescribed wavelength light depends on a sensitivity unevenness of the elements or a heat storage unevenness of the paper sheet when the intensity of the prescribed wavelength light detected by some of the plurality of elements falls within the second range, and a difference from a boundary value of the first range is not equal to or more than a constant value.

6. The paper sheet handling device according to claim 1, wherein the control unit transports the bill to a collection box for collecting the paper sheet and collects the bill when it is determined that the paper sheet is the repair paper sheet, and transports the bill to a storage box for recycling the paper sheet and stores the bill when it is determined that the paper sheet is the folded bill.

* * * * *